US008550454B2

(12) United States Patent
Fujita et al.

(10) Patent No.: US 8,550,454 B2
(45) Date of Patent: Oct. 8, 2013

(54) SHEET DETECTION APPARATUS AND IMAGE FORMING APPARATUS

(75) Inventors: Masahiko Fujita, Osaka (JP); Masaharu Kimura, Osaka (JP); Norichika Katsura, Osaka (JP); Shinichiroh Hiraoka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 208 days.

(21) Appl. No.: 12/954,978

(22) Filed: Nov. 29, 2010

(65) Prior Publication Data

US 2011/0140346 A1 Jun. 16, 2011

(30) Foreign Application Priority Data

Dec. 10, 2009 (JP) ..... 2009-280600

(51) Int. Cl.
*B65H 31/00* (2006.01)

(52) U.S. Cl.
USPC ..... 271/207; 271/220

(58) Field of Classification Search
USPC ..... 271/207, 220; 399/405
See application file for complete search history.

(56) References Cited

U.S. PATENT DOCUMENTS

| | | | | |
|---|---|---|---|---|
| 5,599,009 | A | 2/1997 | Mandel et al. | |
| 5,603,492 | A | 2/1997 | Mandel et al. | |
| 5,609,333 | A | 3/1997 | Mandel et al. | |
| 5,815,764 | A | 9/1998 | Tomory | |
| 5,823,529 | A | 10/1998 | Mandel et al. | |
| 6,142,469 | A | 11/2000 | Nanba et al. | |
| 2002/0113362 | A1 * | 8/2002 | Saito et al. | 271/207 |
| 2003/0062669 | A1 * | 4/2003 | Yamakawa et al. | 271/176 |

FOREIGN PATENT DOCUMENTS

| | | |
|---|---|---|
| JP | 60-236937 | 11/1985 |
| JP | 09-124224 | 5/1997 |
| JP | 11-147666 | 6/1999 |
| JP | 2002-068581 | 3/2002 |
| JP | 2002-167119 | 6/2002 |
| JP | 2003-312937 | 11/2003 |
| JP | 2006-290540 | 10/2006 |

* cited by examiner

*Primary Examiner* — Michael McCullough
*Assistant Examiner* — Howard Sanders
(74) *Attorney, Agent, or Firm* — Renner, Otto, Boisselle & Sklar, LLP

(57) ABSTRACT

According to an embodiment of the present invention, a sheet detection apparatus that detects a sheet includes an actuator unit that is rotatable around a rotational axis so as to adopt any of a protruding position in which the actuator unit protrudes into a detection area for detecting the sheet and a retracted position in which the actuator unit is retracted from the detection area, and an operation unit that is capable of switching between a retracted state in which the actuator unit is set to the retracted position and a protruding state in which the actuator unit is set to the protruding position. An image forming apparatus according to an embodiment of the present invention includes the sheet detection apparatus, and the sheet detection apparatus is provided in a main body of the image forming apparatus.

4 Claims, 8 Drawing Sheets

SHEET DETECTION APPARATUS AND IMAGE FORMING APPARATUS

CROSS-REFERENCE TO RELATED APPLICATIONS

This application claims priority under 35 U.S.C. §119(a) on Patent Application No. 2009-280600 filed in Japan on Dec. 10, 2009, the entire contents of which are herein incorporated by reference.

BACKGROUND OF THE INVENTION

1. Field of the Invention

The present invention relates to a sheet detection apparatus and an image forming apparatus including the sheet detection apparatus.

2. Related Art

As a conventional sheet detection apparatus that detects a sheet, an actuator-type sheet detection apparatus is often used. In this sheet detection apparatus, for example, a contacted portion of an actuator unit is caused to protrude into a detection area for detecting a sheet, and due to the contacted portion making contact with the sheet to be detected, the actuator unit rotates around a rotational axis and thus detects the sheet.

With this sheet detection apparatus, in an ordinary state, because the actuator unit is protruding into the detection area, the actuator unit protruding into the detection area is a nuisance, and for example, when installing or removing a member provided near the actuator unit, if installation or removal work is not carefully performed, the actuator unit becomes detached or the like, so workability for installing or removing a member provided near the actuator unit worsens.

For example, JP 2006-290540A proposes an image forming apparatus in which a first detection member supported so as to be capable of moving to follow the accumulated amount of sheets that have been discharged onto a tray where sheets discharged from the image forming apparatus are placed, a second detection member that contacts part of the tray when the tray has been installed in an apparatus main body and is supported so as to be capable of moving according to installation/removal of the tray to/from the apparatus main body, and a detection means configured to be capable of detecting these detection members, are provided in the apparatus main body.

With this image forming apparatus, due to providing the detection members and the detection means in the apparatus main body, in an ordinary state, the first detection member protrudes into the detection area (further to the outside than an outer cover), so there is the problem that installation/removal of a member (for example, an outer member such as an outer cover) provided near the actuator unit is troublesome.

With regard to this point, when a sheet detection apparatus is provided on the side of a member provided near the actuator unit, it is possible to improve workability for installation/removal.

For example, in an image forming apparatus, when a configuration is adopted in which a sheet tray is provided where sheets to be processed by the image forming apparatus (specifically, recording sheets used for image forming, or original sheets used for original reading by an original reading apparatus) are placed, and sheets that have been placed in the sheet tray are detected by the sheet detection apparatus, when the sheet detection apparatus is provided on the side of the sheet tray, it is possible to simplify work of installation/removal such as exchanging the sheet tray or attaching optional sheet tray.

However, when the sheet detection apparatus is provided on the side of the sheet tray, when installing/removing the sheet tray, it is necessary to attach/remove a connector of a connection cable in the sheet detection apparatus to/from a connector on the side of the main body of the image forming apparatus, and this complicates the work of installing/removing the sheet tray.

SUMMARY OF THE INVENTION

It is an object of the present invention to provide a sheet detection apparatus that detects a sheet and improves workability for installing or removing a member (for example, such as a discharge tray or an outer member) installed near an actuator unit, and to provide an image forming apparatus including the sheet detection apparatus.

In order to address the above problems, the present invention provides the following sheet detection apparatus and the following image forming apparatus.

(1) Sheet Detection Apparatus

The present invention provides a sheet detection apparatus that detects a sheet, the apparatus including an actuator unit that is rotatable around a rotational axis so as to adopt any of a protruding position in which the actuator unit protrudes into a detection area for detecting the sheet and a retracted position in which the actuator unit is retracted from the detection area, and an operation unit that is capable of switching between a retracted state in which the actuator unit is set to the retracted position and a protruding state in which the actuator unit is set to the protruding position.

(2) Image Forming Apparatus

The present invention provides an image forming apparatus including the sheet detection apparatus according to the present invention, the sheet detection apparatus being provided in a main body of the image forming apparatus.

According to the sheet detection apparatus and the image forming apparatus of the present invention, with the operation unit, it is possible to maintain the retracted state and keep the actuator unit in the retracted position. Accordingly, in an ordinary state (for example, a state in which installation or removal work can be performed, such as a state in which power is off or a standby state), it is possible to retract the actuator unit from the detection area, and thus there is no interference from the actuator unit, so it is possible to improve the workability for installing or removing a member (for example, such as a discharge tray or an outer member) provided near the actuator unit.

Moreover, according to the image forming apparatus of the present invention, by the sheet detection apparatus being provided in the main body of the image forming apparatus, it is not necessary to consider attachment or removal of a connector of a connection cable in the sheet detection apparatus when installing or removing a member provided near the sheet detection apparatus, and to that extent it is possible to improve workability for installing or removing a member provided near the sheet detection apparatus.

The "sheet" detected by the sheet detection apparatus according to the present invention is a concept that encompasses a recording sheet such as recording paper used for image forming in the image forming apparatus, as well as an original sheet used when reading an original image with an image reading apparatus provided in the image forming apparatus.

In the sheet detection apparatus and the image forming apparatus according to the present invention, by way of example, an embodiment is possible in which the operation unit maintains the retracted state and sets the actuator unit to the retracted position when the operation unit is off, and switches to the protruding state and sets the actuator unit to the protruding position when the operation unit is on.

With this embodiment, it is possible to keep the actuator unit in the retracted position in a state in which power is off. Thus, it is possible to make it easier to perform installation or removal work in a state in which power is off.

In this embodiment, it is possible to further provide a detection unit that detects whether or not the sheet is present based on whether or not a phenomenon occurs in which the actuator unit does not change from the protruding state to the retracted position even though the operation unit is switched from on to off. With this configuration, it is possible to detect the sheet by detecting the position of the actuator unit, so the sheet can be detected without disposing a light sensor or the like in the detection area.

In the sheet detection apparatus and the image forming apparatus according to the present invention, by way of example, an embodiment is possible in which a detection unit that detects the actuator unit is provided, and the actuator unit has a contacted portion contacted by the sheet to be detected, a detected portion detected by the detection unit, and an operated portion operated by the operation unit, and the detection unit detects the detected portion, and the operation unit rotates the operated portion around the rotational axis.

With this embodiment, it is possible to realize a retracted state for the actuator unit by the operation unit with a simple configuration of the actuator unit.

In the sheet detection apparatus and the image forming apparatus according to the present invention, it is preferable that the contact portion, the detected portion, and the operated portion each are provided at the rotational axis, protruding to the outside in the radial direction of the rotational axis, the contacted portion and the detected portion being provided so as to form an obtuse angle in the circumferential direction of the rotational axis, and the operated portion being provided between the contacted portion and the detected portion that form the obtuse angle in the circumferential direction of the rotational axis.

In this case, the operation unit and the detection unit can be provided in a balanced manner with respect to the actuator unit, and thus it is possible to realize a more compact configuration of the sheet detection apparatus.

In the sheet detection apparatus and the image forming apparatus according to the present invention, by way of example, an embodiment is possible in which the operation unit is provided with a movable member capable of moving back-and-forth in the axial direction of the rotational axis, a drive apparatus that moves the movable member, and a rotating member that is provided in the movable member and rotates the operated portion around the rotational axis according to movement of the movable member.

With this embodiment, it is possible to rotate the actuator unit around the rotational axis with a simple configuration of converting back-and-forth movement of the movable member to rotational movement of the rotational axis via the operated portion by the rotating member.

In the sheet detection apparatus and the image forming apparatus according to the present invention, by way of example, an embodiment is possible in which the actuator unit is set to a biased state biased in the retracting direction in which the actuator unit rotates to the retracted position, the movable member is set to a biased state biased in one direction in the axial direction, the drive apparatus drives so as to move the movable member to the other side in the axial direction when the operation unit is on, the rotating member has an inclined portion that is inclined in the axial direction between the one side and the other side in the axial direction, and the operated portion, by sliding on the inclined portion against biasing force in the retracting direction of the actuator unit according to movement to the other side in the axial direction of the movable member, is rotated in the protruding direction opposite to the retracting direction.

With this embodiment, it is possible to realize the retracted state for the actuator unit by the operation unit when the operation unit is switched off with a simple configuration, and moreover, in a state in which a load is applied to the contacted portion and the actuator unit is in the protruding position, it is possible to automatically return the actuator unit to the retracted position with the biasing force on the actuator unit when the load on the contacted portion is released.

In the sheet detection apparatus and the image forming apparatus according to the present invention, by way of example, an embodiment is possible in which a plunger-type solenoid apparatus having a plunger and a solenoid is provided, with the plunger serving as the movable member, and the solenoid serving as the drive apparatus.

With this embodiment, a general-purpose plunger-type solenoid apparatus can be used, and thus, it is possible to realize the retracted state for the actuator unit by the operation unit when the operation unit is switched off with an inexpensive and simple configuration.

In the sheet detection apparatus and the image forming apparatus according to the present invention, the detection unit is preferably a light sensor.

In this case, it is possible to use a general-purpose light sensor, and thus it is possible to inexpensively and reliably detect the detected portion.

In the image forming apparatus according to the present invention, by way of example, an embodiment is possible in which a sheet tray where a sheet is placed is provided, and the sheet detection apparatus detects whether or not there is a sheet in the sheet tray.

With this embodiment, the sheet detection apparatus is provided in the main body of the image forming apparatus, so it is not necessary to perform attachment or removal of a connector of a connection cable of the sheet detection apparatus when installing or removing the sheet tray, and thus it is possible to more easily perform work of installing or removing the sheet tray.

In the image forming apparatus according to the present invention, by way of example, an embodiment is possible in which the sheet tray is attachable to and removable from the main body of the image forming apparatus.

With this embodiment, the sheet detection apparatus detects whether or not there is a sheet in the sheet tray that is attachable to and removable from the main body of the image forming apparatus, and the sheet detection apparatus is provided in the main body of the image forming apparatus, so it is not necessary to perform attachment or removal of a connector of a connection cable of the sheet detection apparatus when installing or removing the sheet tray, and thus it is possible to more easily perform work of installing or removing the sheet tray.

In the image forming apparatus according to the present invention, by way of example, an embodiment is possible in which the sheet tray is a discharge tray where a sheet that has been transported within the main body of the image forming apparatus and then discharged outside of the main body is placed.

In the image forming apparatus according to the present invention, by way of example, an embodiment is possible in which the sheet tray is a discharge tray where a sheet that has been transported within the main body of the image forming apparatus and then discharged outside of the main body is placed, and the discharge tray is attachable to and removable from the main body of the image forming apparatus.

The configuration in this embodiment can be appropriately used when the discharge tray is added as an option, for example. Note that other than the discharge tray, examples of a sheet tray that is attachable to and removable from the main body of the image forming apparatus include a sheet feed tray (for example, a manual feed tray) where sheets are placed, for supplying sheets into the main body of the image forming apparatus, and an original tray where originals are placed, for supplying originals to an original reading unit within the main body of the image forming apparatus that is provided with a copy function of reading an image of an original and forming that image on a sheet.

In the image forming apparatus according to the present invention, it is preferable that an upstream-side sheet detection unit is provided that detects a sheet on the upstream side relative to the discharge tray in the sheet discharge direction, and the operation unit of the sheet detection apparatus maintains the retracted state and sets the actuator unit to the retracted position when the operation unit is off, and switches to the protruding state and sets the actuator unit to the protruding position when the operation unit is on, and when the upstream-side sheet detection unit detects sheet transport, the operation unit of the sheet detection apparatus is switched on, and after passage of a sheet discharge time from the start of sheet transport detection by the upstream-side sheet detection unit until the sheet is placed on the discharge tray, the operation unit of the sheet detection apparatus is switched off.

In this case, without supplying power to the operation unit, by utilizing the weight of the sheet, the protruding state is maintained and the actuator unit is set to the protruding position by the sheet that has been placed in the discharge tray, and when the sheet is afterward removed from the discharge tray, the actuator unit moves from the protruding position to the retracted position due to the biasing force on the actuator unit, so the operation unit can be automatically switched from the protruding state to the retracted state.

DESCRIPTION OF THE PREFERRED EMBODIMENTS

Hereinafter, an embodiment(s) of the present invention will be described with reference to the drawings. Note that the below embodiment(s) is only an example of the present invention, and is not of a nature limiting the technical scope of the present invention.

(Overall Configuration of Image Forming Apparatus 20)

Figure 1:
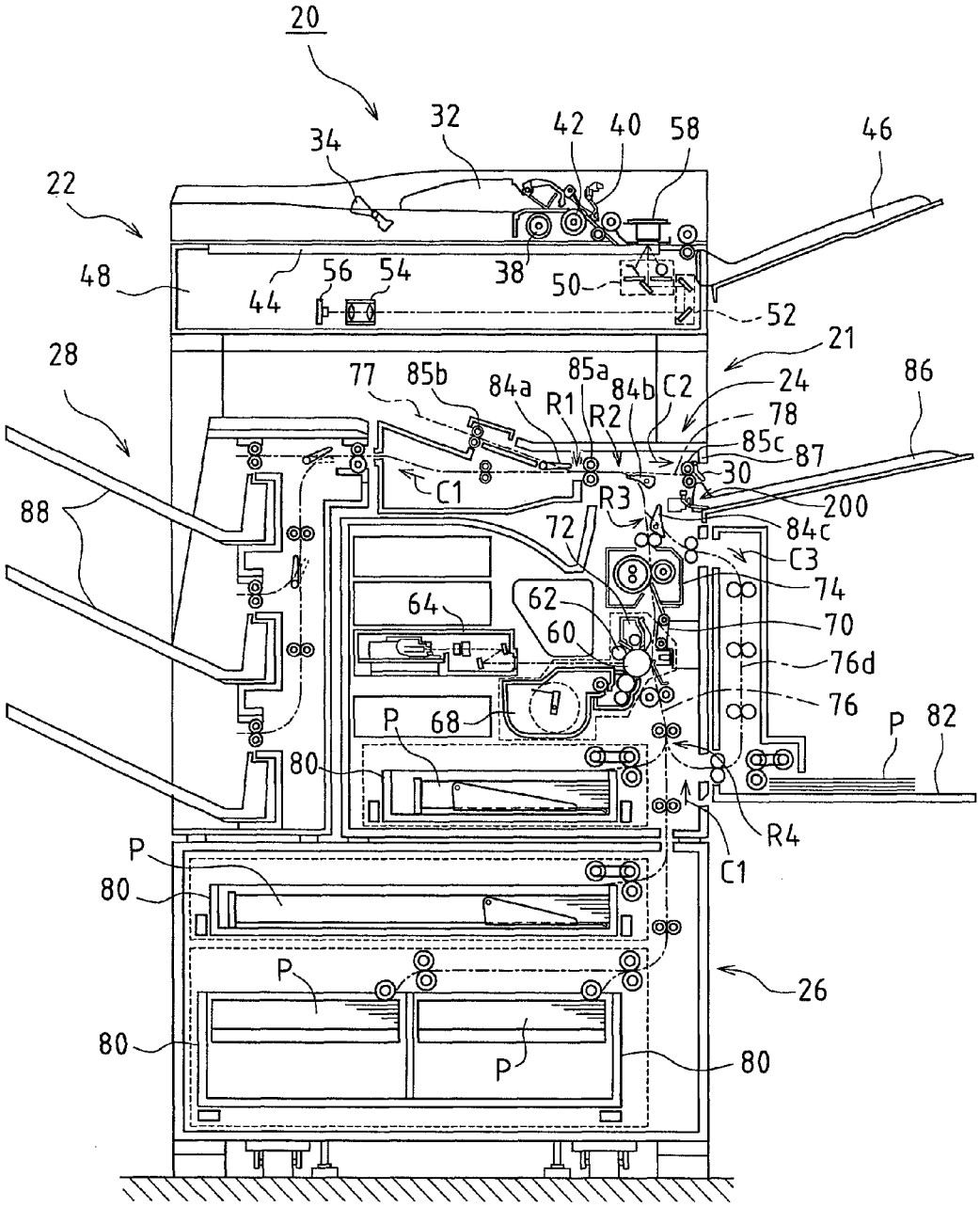
FIG. 1 is a cross-sectional view that shows the schematic configuration of an image forming apparatus including a sheet detection apparatus according to an embodiment of the present invention.
Figure 2:
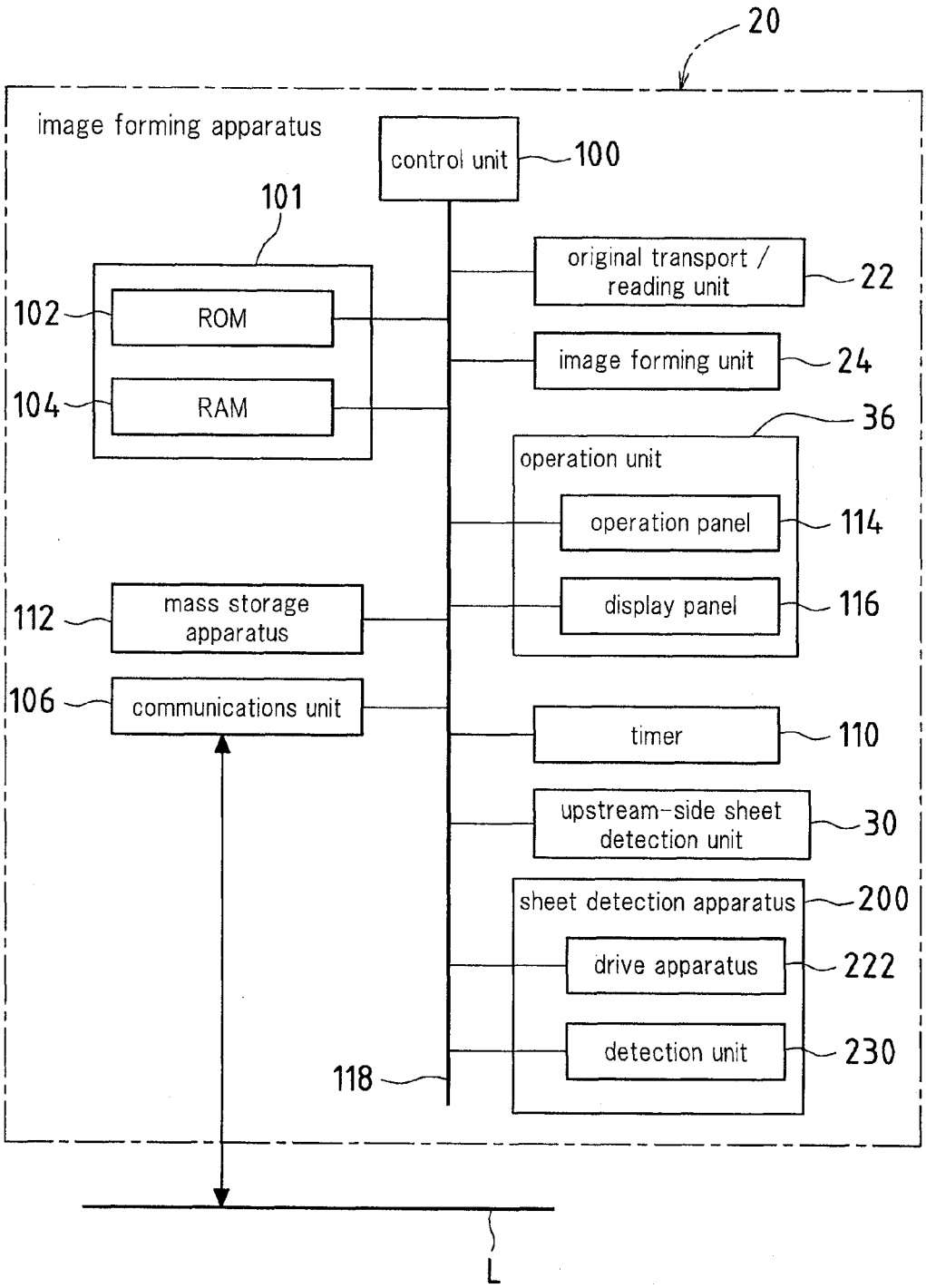
FIG. 2 is a block diagram that shows the hardware configuration of the image forming apparatus.

FIG. 1 is a cross-sectional view that shows the schematic configuration of an image forming apparatus 20 including a sheet detection apparatus 200 according to an embodiment of the present invention. FIG. 2 is a block diagram that shows the hardware configuration of the image forming apparatus 20.

Herein, the image forming apparatus 20 is configured as a digital multifunction device that includes a copy function of reading an original and printing an image, a facsimile function of performing facsimile communications, and a printer function of printing image data from an external apparatus (not shown) such as an information terminal apparatus.

As shown in FIG. 1, the image forming apparatus 20 is capable of selectively switching between a copy mode in which an image of an original is read and printed on a recording sheet (referred to below as recording paper, as an example of a sheet) P such as a recording paper, a facsimile mode in which an image of an original is read and sent, and an image of an original is received and printed on the recording paper P, and a printer mode in which an image received from an external apparatus via a communications means such as a network is printed on the recording paper P.

A main body 21 of the image forming apparatus 20 includes an original reading apparatus (here, an original transport/reading unit) 22 capable of reading an original image, an image forming unit 24 that performs printing output by using an electrophotographic forming process to reproduce the colors of the image read by the original transport/reading unit 22 and form that image on the recording paper P, an operation unit 36 whereby it is possible to perform settings of various functions related to image forming processing, a paper feed unit 26, and a discharge processing apparatus 28. Also, as shown in FIG. 2, the image forming apparatus 20 further includes a control unit 100, a storage unit 101, a mass storage apparatus 112 such as an HDD (Hard Disk Drive), a communications unit 106, and a timer 110. Note that the paper feed unit 26 and the discharge processing apparatus 28 shown in FIG. 1 are omitted from FIG. 2. Also, an upstream-side sheet detection unit 30 and the sheet detection apparatus 200 will be described in detail later.

Here, the internal configuration of the image forming apparatus 20 will be described in the course of describing operation in the copy mode.

When an original is placed on an original placement tray 32 of the original transport/reading unit 22, an original detection sensor 34 detects that the original has been placed. Then, by operating the operation unit 36 (not shown in FIG. 1, see FIG. 2), print paper size, magnification factor, and so forth are input and set. Then, a copy start instruction is performed according to the content of operation of the operation unit 36. The operation unit 36 includes an operation panel 114 whereby operations to instruct various processing or operations to input or select various processing information are performed, and a display panel 116 that displays various processing information regarding which instruction, input, or selection operations have been performed.

In response to operation of the operation unit 36, in the original transport/reading unit 22, the original on the original placement tray 32 is drawn out page-by-page by a pickup roller 38, and fed out between a separation plate 40 and a transport roller 42 to a glass platen 44, and then the original is transported in the sub-scanning direction on the glass platen 44 and discharged to an original discharge tray 46.

At this time, a front face (lower side face) of the original is read by a first reading unit 48. A first scanning unit 50 of the first reading unit 48 is positioned by moving to a predetermined position, and a second scanning unit 52 is positioned at a predetermined position. The front face of the original is irradiated via the glass platen 44 by an exposure lamp of the first scanning unit 50, and reflected light of the original is guided to an imaging lens 54 by respective reflecting mirrors of the first scanning unit 50 and the second scanning unit 52 and focused on a CCD (Charge Coupled Device) 56 by the imaging lens 54, so that an image of the front face of the original is formed on the CCD 56. Thus, an image of the front face of the original is read.

A back face (upper side face) of the original is read by a second scanning unit 58. The second reading unit 58 is disposed above the glass platen 44. The second reading unit 58 is provided with a exposure lamp that includes a light source such as an LED (Light Emitting Diode) array or a fluorescent lamp and irradiates the back face of the original, a Selfoc lens array that focus reflected light of the original on a per-pixel basis, and a contact image sensor (CIS) that photoelectrically converts reflected light of the original received via the Selfoc lens array and outputs an analog image signal.

Further, in the image forming apparatus 20, it is possible to open the upper case of the original transport/reading unit 22, place an original on the glass platen 44, and in this state read the front face of the original with the first reading unit 48. In this case, the first scanning unit 50 and the second scanning unit 52 are moved in the sub-scanning direction while maintaining a predetermined speed relative to each other, the original on the glass platen 44 is exposed with the first scanning unit 50, reflected light from the original is guided to the imaging lens 54 by the first scanning unit 50 and the second scanning unit 52, and an image of the original is formed on the CCD 56 by the imaging lens 54.

When one face or both faces of an original are read as described above, image data that represents an image of one face or both faces of the original is input to the control unit 100 (see FIG. 2) that includes a microcomputer, here various image processing is performed on the image data, and then the image data is output to the image forming unit 24.

The image forming unit 24 prints the image of the original represented by the image data on recording paper P, and includes a photosensitive drum 60, a charging apparatus 62, a laser scanning unit (referred to below as an LSU) 64, a development apparatus 68, a transfer apparatus 70, a cleaning apparatus 72, a fixing apparatus 74, and an unshown charge removal apparatus.

A transport path that includes a main transport path 76 is provided in the image forming unit 24, and recording paper P that has been fed from the paper feed unit 26 is transported along the main transport path 76. The paper feed unit 26, page-by-page, draws out recording paper P stored in a paper cassette 80 or recording paper P placed in a manual feed tray 82, and feeds out this recording paper P to the main transport path 76 of the image forming unit 24.

In the course of transport of the recording paper P along the main transport path 76 of the image forming unit 24, the recording paper P passes between the photosensitive drum 60 and the transfer apparatus 70, and further passes through the fixing apparatus 74, and printing to the recording paper P is performed.

The photosensitive drum 60 rotates in one direction, and after the surface of the photosensitive drum 60 has been cleaned by the cleaning apparatus 72 and the charge removal apparatus, the surface of the photosensitive drum 60 is uniformly charged by the charging apparatus 62.

The LSU 64 modulates laser light based on the image data from the original transport/reading unit 22, and repeatedly scans the surface of the photosensitive drum 60 in the main scanning direction with this laser light, thus forming an electrostatic latent image on the surface of the photosensitive drum 60.

The development apparatus 68 supplies toner to the surface of the photosensitive drum 60 to develop the electrostatic latent image and form a toner image on the surface of the photosensitive drum 60.

The transfer apparatus 70 transfers the toner image that has been formed on the photosensitive drum 60 to recording paper P that passes between the transfer apparatus 70 and the photosensitive drum 60.

The fixing apparatus 74 fixes the toner image on the recording paper P by applying heat and pressure to the recording paper P.

The control unit 100 serves for control of the entire image forming apparatus 20, and includes a CPU (Central Processing Unit). The control unit 100 is connected via a signal path 118 to the original transport/reading unit 22, the image forming unit 24, the operation unit 36, the storage unit 101, the mass storage apparatus 112, the communications unit 106, and the timer 110.

The storage unit 101 includes storage apparatus such as a ROM (Read-Only Memory) 102 and a RAM (Random Access Memory) 104. Information such as programs and data necessary for controlling operation of the image forming apparatus 20 are stored in the ROM 102 of the storage unit 101. The control unit 100 controls the image forming apparatus 20 according to the programs and data stored in the ROM 102, and executes control related to the various functions of the image forming apparatus 20.

The RAM 104 of the storage unit 101 has the function of a working memory that temporarily stores the results of computation and processing by the control unit 100, the function of a backup memory that stores a count value, paper jam and service error history information, information regarding consumable parts, and so forth, and the function of a frame memory that stores image data.

The mass storage apparatus 112 is provided in order to realize a document filing function for storing input image data of the image forming apparatus 20. This document filing function involves receiving an image that has been read with a scanner, or an image that has been sent from an external device such as a personal computer (referred to below as a PC) or a facsimile apparatus, and storing the received image in the mass storage apparatus 112. The image that has been stored in the mass storage apparatus 112 is managed in the RAM 104. The stored image is read out with a PC, printed by operating the operation panel 114, sent to an external device using a sending tool such as faxing or e-mail, or the like.

The communications unit 106 functions as an interface to a communications means L such as a network connected to an external apparatus (not shown) such as a facsimile apparatus or a PC.

The timer 110, under instruction by the control unit 100, measures a sheet discharge time T by control of an operation to detect recording paper P, described later.

The control unit 100 performs various control when discharging recording paper P that has been printed in the image forming unit 24.

Figure 3:
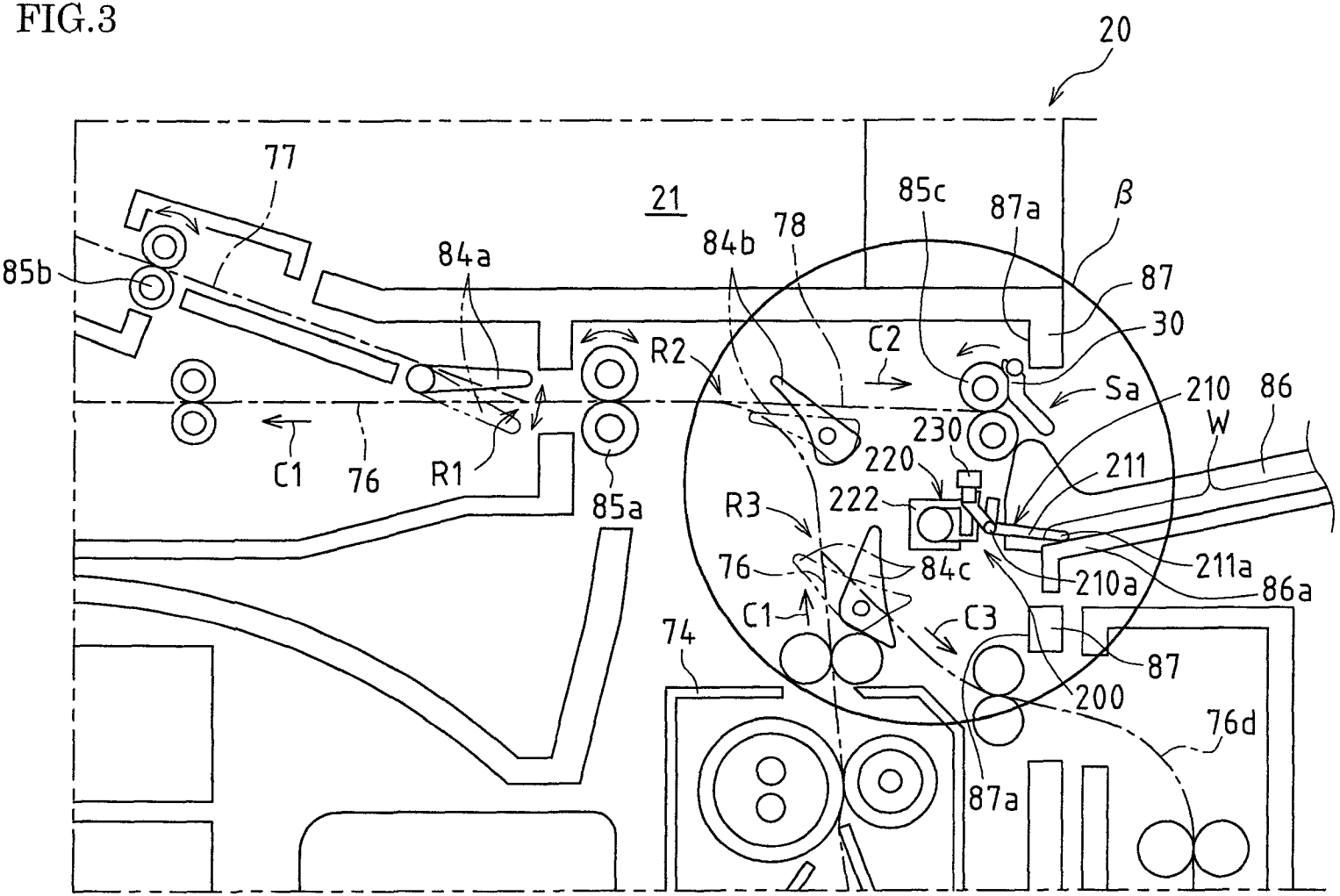
FIG. 3 illustrates a transport path when discharging recording paper in the image forming apparatus shown in FIG. 1.
Figure 4A:
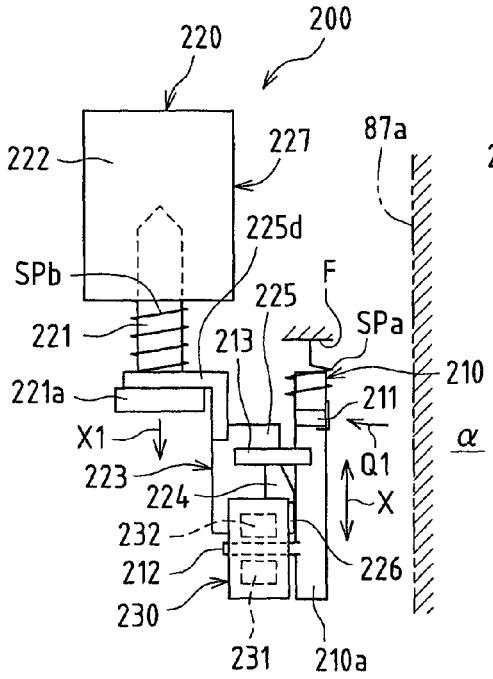
FIGS. 4(*a*) to 4(*d*) are schematic configuration views for illustrating the sheet detection apparatus, with FIG. 4(*a*) being a plan view in which the sheet detection apparatus is viewed from above when an actuator unit is in a retracted position, FIG. 4(*b*) being a side view in which the sheet detection apparatus shown in FIG. 4(*a*) is viewed from the side, FIG. 4(*c*) being a plan view in which the sheet detection apparatus is viewed from above when the actuator unit is in a protruding position, and FIG. 4(*d*) being a side view in which the sheet detection apparatus shown in FIG. 4(*c*) is viewed from the side.
Figure 4C:
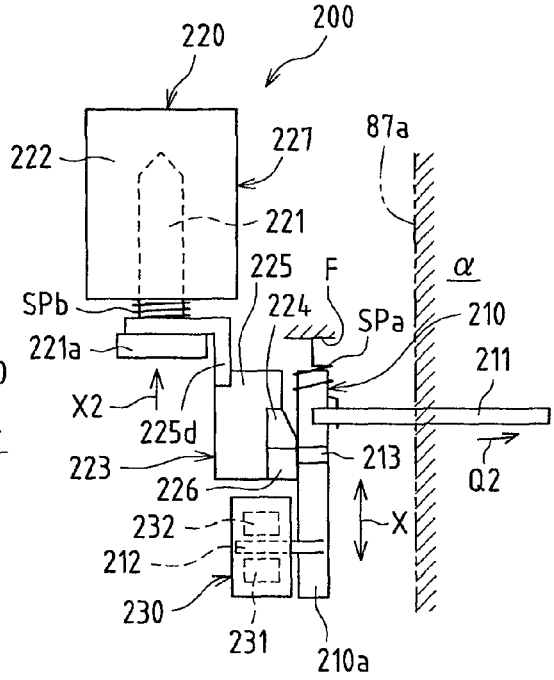
Figure 4B:
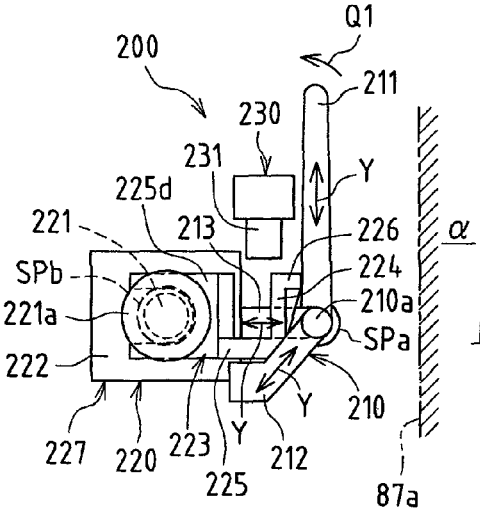
Figure 4D:
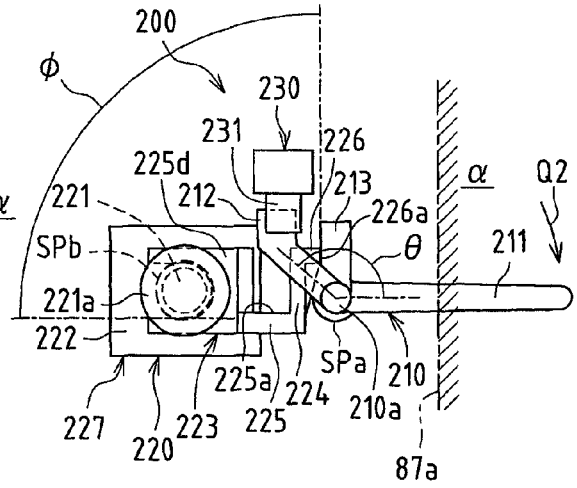

FIG. 3 illustrates the transport path when discharging recording paper P in the image forming apparatus 20 shown in FIG. 1.

As shown in FIGS. 1 and 3, the main transport path 76, a sub-transport path 77, a discharge transport path 78, and a reverse transport path 76*d* are provided in the image forming apparatus 20 as transport paths where recording paper P can be transported.

The main transport path 76 is configured as a transport path where recording paper P is transported between the paper feed unit 26 and the discharge processing apparatus 28.

The sub-transport path 77 is configured as a transport path branched at a first branch portion R1 (here, branched diagonally upward to the left) from the transport path between the fixing apparatus 74 and the discharge processing apparatus 28 in the main transport path 76. The discharge transport path 78 is configured as a transport path branched at a second branch portion R2 (here, branched horizontally) from the transport path on the fixing apparatus 74 side relative to the first branch portion R1 in the main transport path 76. The reverse transport path 76*d* is configured as a transport path branched at a third branch portion R3 (here, branched diagonally downward to the right) from the transport path between the fixing apparatus 74 and the second branch portion R2, and connected to a connecting portion R4 between the image forming unit 24 and the paper feed unit 26.

A first transport roller pair 85*a* capable of forward rotation and reverse rotation is provided in the main transport path 76 between the first branch portion R1 and the second branch portion R2. A second transport roller pair 85*b* capable of forward rotation and reverse rotation is provided in the sub-transport path 77. A discharge roller pair 85*c* that rotates in reverse is provided in the discharge transport path 78. Forward rotation is rotation in the transport direction that transports recording paper P from the fixing apparatus 74 toward the discharge processing apparatus 28 (the direction of arrow C1 in FIGS. 1 and 3). Reverse rotation is rotation in the opposite direction as forward rotation, that is, in the direction that recording paper P is transported in the reverse transport direction that is the opposite direction as the transport direction C1. Here, the reverse transport direction includes a discharge direction in which recording paper P is transported via the discharge transport path 78 toward a discharge opening Sa (the direction of arrow C2 in FIGS. 1 and 3), and a reverse direction in which recording paper P is transported via the reverse transport path 76*d* toward the connecting portion R4 (the direction of arrow C3 in FIGS. 1 and 3).

First to third branch claws 84*a*, 84*b*, and 84*c* are respectively disposed in the first to third branch portions R1, R2, and R3.

The first branch claw 84*a* is configured to adopt a first position (the position indicated by solid lines in FIG. 3) that guides recording paper P from the first transport roller pair 85*a* toward the discharge processing apparatus 28, and a second position (the position indicated by long dashed double-short dashed lines in FIG. 3) that guides recording paper P from the first transport roller pair 85*a* toward the second transport roller pair 85*b*.

The second branch claw 84*b* is configured to adopt a first position (the position indicated by solid lines in FIG. 3) that guides recording paper P from the fixing apparatus 74 toward the first transport roller pair 85*a*, or guides recording paper P transported by reverse rotation of the first and second transport roller pairs 85*a* and 85*b* via the first branch claw 84*a* adopting the second position toward the third branch claw 84*c*, and a second position (the position indicated by long dashed double-short dashed lines in FIG. 3) that guides recording paper P transported in reverse by reverse rotation of the first and second transport roller pairs 85*a* and 85*b* via the first branch claw 84*a* adopting the second position toward the discharge roller pair 85*c* that is rotated in reverse.

The third branch claw 84*c* is configured to adopt a first position (the position indicated by solid lines in FIG. 3) that guides recording paper P from the fixing apparatus 74 toward the second branch claw 84*b*, and a second position (the position indicated by long dashed double-short dashed lines in FIG. 3) that guides recording paper P transported in reverse by reverse rotation of the first and second transport roller pairs 85*a* and 85*b* via the first branch claw 84*a* adopting the second position and the second branch claw 84*b* adopting the first position toward the connecting portion R4.

In the image forming apparatus 20 having this configuration, when printing of copy images or print images is performed, the first to third branch claws 84*a* to 84*c* are each set to the first position, and recording paper P is transported from the fixing apparatus 74 to the discharge processing apparatus 28.

When printing of facsimile images is performed, first, the first branch claw 84*a* is set to the second position and the second and third branch claws 84*b* and 84*c* are set to the first position, and recording paper P is temporarily transported from the fixing apparatus 74 to the sub-transport path 77. Then, the second branch claw 84*b* is set to the second position, and the recording paper P is transported from the sub-transport path 77 in the discharge direction C2, and discharged to a discharge tray (an example of a sheet tray, referred to below as a discharge tray) 86. That is, recording paper P that has been transported within the main body 21 of the image forming apparatus 20 and then discharged outside of the main body 21 is placed in the discharge tray 86.

When printing is performed on both faces of recording paper P, first, the first branch claw 84*a* is set to the second position and the second and third branch claws 84*b* and 84*c* are set to the first position, and recording paper P is temporarily transported from the fixing apparatus 74 to the sub-transport path 77. Then, the third branch claw 84*c* is set to the second position, and the recording paper P is transported from the sub-transport path 77 in the reverse direction C3, the front and back of the recording paper P are reversed, and the recording paper P is transported to the connecting portion R4. After being transported to connecting portion R4, the recording paper P is transported along the main transport path 76, and during that transport printing is performed on the face of the recording paper P that has not yet been printed.

In the discharge processing apparatus 28, processing to sort and discharge a plurality of recording papers P to individual discharge trays 88, processing to punch holes in the recording papers P, and processing to staple the recording papers P are performed. For example, when creating a plurality of copies of printed items, such that one copy of the printed items is allocated to each discharge tray 88, the recording papers P are sorted and discharged to the individual discharge trays 88, and for each discharge tray 88, the punch processing and the staple processing are performed on each sheet of recording paper P on the discharge tray 88 to create each copy of the printed items.

Recording paper P that has been printed in the above manner is guided toward the discharge processing apparatus 28 and discharged to any of the discharge trays 88 of the discharge processing apparatus 28, or guided toward the discharge tray 86 and discharged to the discharge tray 86.

In the image forming apparatus 20, processing operation (here, operation ceasing display that indicates facsimile receiving, in response to recording paper P being present in the discharge tray 86) is performed according to whether recording paper P that has been printed according to image data of a received facsimile and discharged to the discharge tray 86 is present in the discharge tray 86. Therefore, the presence of recording paper P in the discharge tray 86 is detected by the sheet detection apparatus 200.

In the present embodiment, the discharge tray 86 is configured to be attachable to and removable from the main body 21 of the image forming apparatus 20. Specifically, the discharge tray 86 is configured as an optional member that can be installed later.

(Sheet Detection Apparatus 200)

Incidentally, in the image forming apparatus 20, in order to simplify installation/removal work such as exchanging the discharge tray 86 or attaching the discharge tray 86 as an option, it is conceivable to provide the sheet detection apparatus 200 on the side of the discharge tray 86, but in this case, when installing/removing the discharge tray 86, it is necessary to attach/remove a connector (not shown) of a connection cable in the sheet detection apparatus 200, and this interferes with the work of installing/removing the discharge tray 86.

Consequently, in the image forming apparatus 20 of the present embodiment, the sheet detection apparatus 200 is provided in the main body 21, and is configured as follows.

As shown in FIG. 3, the sheet detection apparatus 200 is disposed near a base end portion 86*a* of the discharge tray 86. When a drive apparatus 222 is off and an actuator unit 210 is in a retracted position, the sheet detection apparatus 200 is disposed at a position inside (to the main body 21 side) relative to an inner face 87*a* of an outer member 87. Also, when the drive apparatus 222 is on and the actuator unit 210 is in a protruding position, the sheet detection apparatus 200 is disposed at a position where at least a tip end portion 211*a* of a contacted portion 211 overlaps a sheet placement area W where recording paper P is placed in the discharge tray 86.

The image forming apparatus 20 is further provided with an upstream-side sheet detection unit 30. The upstream-side sheet detection unit 30 detects recording paper P on the upstream side of the discharge tray 86 in the discharge direction C2 of the recording paper P.

Specifically, the upstream-side sheet detection unit 30 is provided in the discharge transport path 78 (here, near the discharge opening Sa).

The upstream-side sheet detection unit 30 is connected to an input system of the control unit 100 (see FIG. 2), and sends a detection signal that indicates a recording paper P transport timing (the timing at which the recording paper P passes by the upstream-side sheet detection unit 30) to the control unit 100.

In the present embodiment, examples are described of, in the control unit 100, a case where the upstream-side sheet detection unit 30 detects the transport timing of the downstream edge (referred to below as the leading edge) in the discharge direction C2 of recording paper P transported in the discharge direction C2, a case where the upstream-side sheet detection unit 30 detects the transport timing of the upstream edge (referred to below as the trailing edge) in the discharge direction C2 of recording paper P transported in the discharge direction C2, and a case where the upstream-side sheet detection unit 30 detects the transport timing of both a leading edge P1 and a trailing edge P2 of recording paper P transported in the discharge direction C2. A conventionally known sheet detection sensor can be used for the upstream-side sheet detection unit 30, so a detailed description thereof is omitted here.

FIGS. 4(*a*) to 4(*d*) are schematic configuration views for illustrating the sheet detection apparatus 200. FIG. 4(*a*) is a plan view in which the sheet detection apparatus 200 is viewed from above when the actuator unit 210 is in a retracted position, FIG. 4(*b*) is a side view in which the sheet detection apparatus 200 shown in FIG. 4(*a*) is viewed from the side (width direction orthogonal to the transport direction C2 of recording paper P). FIG. 4(*c*) is a plan view in which the sheet detection apparatus 200 is viewed from above when the actuator unit 210 is in a protruding position, and FIG. 4(*d*) is a side view in which the sheet detection apparatus 200 shown in FIG. 4(*c*) is viewed from the side (width direction of recording paper P).

Figure 5A:
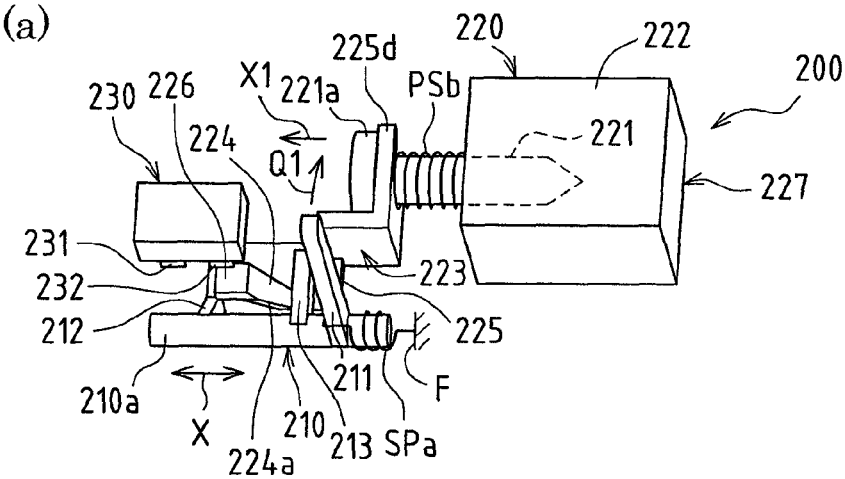
FIGS. 5(*a*) to 5(*c*) are perspective views of the sheet detection apparatus shown in FIGS. 4(*a*) to 4(*d*), with FIG. 5(*a*) showing a retracted state in which the actuator unit is in a retracted position, FIG. 5(*b*) showing an operating state in which the actuator unit is in a position between the retracted position and the protruding position, and FIG. 5(*c*) showing a protruding state in which the actuator unit is in the protruding position.
Figure 5B:
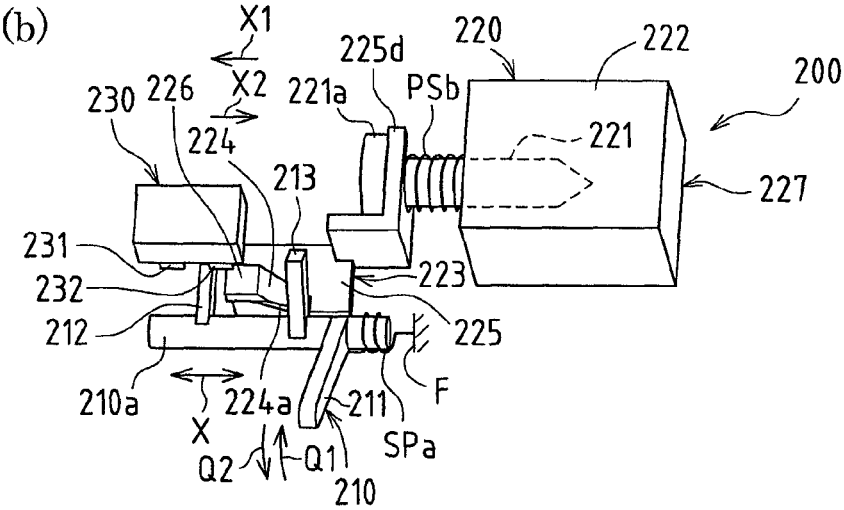
Figure 5C:
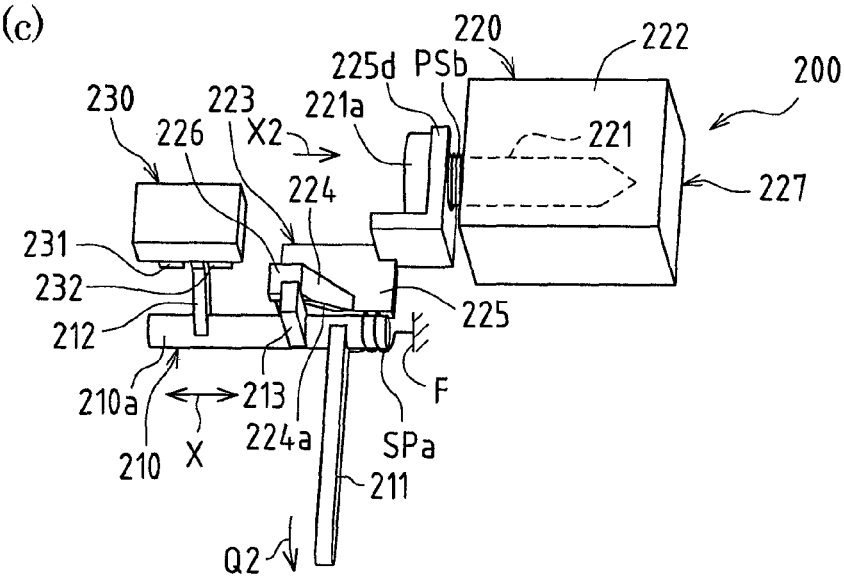

FIGS. 5(*a*) to 5(*c*) are perspective views of the sheet detection apparatus 200 shown in FIGS. 4(*a*) to 4(*d*). FIG. 5(*a*) shows a retracted state in which the actuator unit 210 is in a retracted position, FIG. 5(*b*) shows an operating state in which the actuator unit 210 is in a position between the retracted position and the protruding position. FIG. 5(*c*) shows a protruding state in which the actuator unit 210 is in the protruding position.

The sheet detection apparatus 200 includes the actuator unit 210, an operation unit 220, and a first biasing member SPa.

The actuator unit 210 is configured to be capable of rotating around a rotational axis 210*a* so as to adopt any of a protruding position (see FIGS. 4(*c*), 4(*d*), and 5(*c*)) protruding into a detection area α (see FIGS. 4(*a*) to 4(*d*)) for detecting recording paper P, and a retracted position (see FIGS. 4(*a*), 4(*b*), and 5(*a*)) retracted from the detection area α. Here, the detection area α is an area for detecting whether or not recording paper P is present, and is an area outside relative to the inner face 87*a* of a member (for example, the outer member 87 that is an outer cover or the like) provided near the actuator unit 210.

The sheet detection apparatus 200 is further provided with a detection unit (here, a non-contact detection sensor, specifically a light sensor) 230 that detects the actuator unit 210.

The actuator unit 210 has the contacted portion 211 contacted by the recording paper P to be detected, a detected portion 212 detected by the detection unit 230, and an operated portion 213 operated by the operation unit 220.

In the present embodiment, the contacted portion 211, the detected portion 212, and the operated portion 213 are each provided on the rotational axis 210*a*, protruding to the outside in the radial direction (the direction of arrow Y in FIG. 4(*b*)) of the rotational axis 210*a*. The contacted portion 211 and the detected portion 212 are provided so as to form an obtuse angle (see FIG. 4(*d*)) in the circumferential direction of the rotational axis 210*a*. That is, an angle θ formed by a center line of the contacted portion 211 and a center line of the detected portion 212 is greater than 90 degrees. Furthermore, the operated portion 213 is provided between the contacted portion 211 and the detected portion 212 (on the side forming the obtuse angle) in the circumferential direction of the rotational axis 210*a*. Here, the actuator unit 210 is configured such that the rotational axis 210*a*, the contacted portion 211, the detected portion 212, and the operated portion 213 are formed as a single body. A configuration may also be adopted in which among the contacted portion 211, the detected portion 212, and the operated portion 213, at least two of those are formed as a single body and used for both of those portions. That is, a configuration may be adopted in which the contacted portion 211 and the detected portion 212 are formed as a single body and used for both the contacted portion 211 and the detected portion 212, or a configuration may be adopted in which the detected portion 212 and the operated portion 213 are formed as a single body and used for both the detected portion 212 and the operated portion 213. Also, a configuration may be adopted in which the contacted portion 211 and the operated portion 213 are formed as a single body and used for both the contacted portion 211 and the operated portion 213, or a configuration may be adopted in which the contacted portion 211, the detected portion 212, and the operated portion 213 are formed as a single body and used for the contacted portion 211, the detected portion 212, and the operated portion 213.

The detection unit 230 is connected to the input system of the control unit 100 (see FIG. 2), and detects the detected portion 212 and sends a detection signal indicating whether or not recording paper P is present to the control unit 100. More specifically, the detection unit 230 is configured as a transmissive-type light sensor having a light-emitting portion 231 and a light-receiving portion 232. In the detection unit 230, by blocking incident light that is incident on the light-receiving portion 232 from the light-emitting portion 231 with the detected portion 212 that rotates according to rotation of the rotational axis 210*a*, or allowing such light to pass, the light-receiving portion 232 detects whether or not that incident light is present. When presence of the incident light is detected (when the detected portion 212 is not present between the light-emitting portion 231 and the light-receiving portion 232), the detection unit 230 sends a detection signal indicating that recording paper P is not present to the control unit 100, and when absence of incident light is detected (when the detected portion 212 is present between the light-emitting portion 231 and the light-receiving portion 232), the detection unit 230 sends a detection signal indicating that recording paper P is present to the control unit 100. The detection unit 230 may also be a reflecting-type light sensor.

The first biasing member SPa biases the actuator unit 210 in the retracting direction (the direction of arrow Q1 in the drawings) in which the actuator unit 210 rotates to the retracted position. That is, the actuator unit 210 is put in a state biased in the retracting direction Q1 by the first biasing member SPa. Here, the first biasing member SPa is a spring, with one end fixed to the actuator unit 210 (specifically the contacted portion 211) and the other end inserted through the rotational axis 210*a* in a state connected to the main body 21 (specifically to a main body frame F).

The operation unit 220 operates in such a manner that it is possible to switch between the retracted state in which the actuator unit 210 is put in the retracted position and the protruding state in which the actuator unit 210 is put in the protruding position.

In the present embodiment, the operation unit 220 is configured such that when switched off, the retracted state is maintained and the actuator unit is put in the retracted position, and when switched on, the operation unit 220 is switched to the protruding state and the actuator unit 210 is put in the protruding position.

More specifically, the operation unit 220 rotates the operated portion 213 around the rotational axis 210*a*. Here, the operation unit 220 is provided with a movable member 221 that is movable back-and-forth in the axial direction (the direction of arrow X in FIGS. 4(*a*), 4(*c*), and 5(*a*) to 5(*c*)) of the rotational axis 210*a*, a second biasing member SPb that biases the movable member 221 to one side X1 (see FIGS. 4(*a*) and 5(*a*)) in the axial direction X, the drive apparatus 222 that moves the movable member 221, and a rotating member 223 that is provided in the movable member 221 and rotates the operated portion 213 around the rotational axis 210*a* according to movement of the movable member 221.

The movable member 221 is in a state biased to the one side X1 in the axial direction X by the second biasing member SPb. Here, the movable member 221 is a cylindrical member. A catch portion 221*a* is provided at the end of the movable member 221. The catch portion 221*a* is formed as a round plate with a diameter greater than the diameter of the movable member 221, and is provided at the end of the movable member 221. The second biasing member SPb is a spring, and is disposed in a state inserted through the movable member 221 between the drive apparatus 222 and the catch portion 221*a* of the movable member 221. In order to prevent the movable member 221 from being disconnected from the drive apparatus 222, a regulating member (not shown) that regulates movement of the movable member 221 to the one side X1 in the axial direction X may also be provided.

The drive apparatus 222 drives so as to move the movable member 221 to the other side X2 in the axial direction X when switched on. Also, the rotating member 223 has an inclined portion 224 inclined in the axial direction X between the one side X1 and the other side X2 in the axial direction X. The operated portion 213, by sliding on the inclined portion 224 against the biasing force of the first biasing member SPa according to movement of the movable member 221 to the other side X2 in the axial direction X, is rotated in the protruding direction (the direction of arrow Q2 in the drawings) that is the opposite direction as the retracting direction Q1. Thus, when the operated portion 213 is located to the other side X2 in the axial direction X relative to the inclined portion 224, the actuator unit 210 is put in the retracted position, and when the operated portion 213 is located to the one side X1 in the axial direction X relative to the inclined portion 224, the actuator unit 210 is put in the protruding position. Accordingly, the operation unit 220 is capable of switching between the retracted state in which the actuator unit 210 is put in the retracted position and the protruding state in which the actuator unit 210 is put in the protruding position.

More specifically, the rotating member 223 has, in addition to the inclined portion 224, a first coupled portion 225 that is coupled to the movable member 221 on the other side X2 in the axial direction X and coupled continuously to the inclined portion 224 on the one side X1, and a second coupled portion 226 that is coupled continuously to the inclined portion 224 on the other side X2 in the axial direction X. Here, the rotating member 223 is configured with the inclined portion 224, the first coupled portion 225, and the second coupled portion 226 formed as a single body.

Specifically, the first coupled portion 225 has a contact face 225*a* (see FIG. 4(*d*)) that makes parallel contact with the operated portion 213 when the actuator unit 210 is in the retracted position. The second coupled portion 226 has a contact face 226*a* (see FIG. 4(*d*)) that makes parallel contact with the operated portion 213 when the actuator unit 210 is in the protruding position. An angle ϕ formed by the contact face 225*a* of the first coupled portion 225 and the contact face 226*a* of the second coupled portion 226 is equal to the angle of rotation (here, about 90 degrees) of the actuator unit 210 around the rotational axis 210*a* when the actuator unit 210 moves between the retracted position and the protruding position. The detected portion 212 is provided at the rotational axis 210*a* so as to be detected by the detection unit 230 when the actuator unit 210 is in the protruding position (here, so as to block light between the light-emitting portion 231 and the light-receiving portion 232), and so as to not be detected by the detection unit 230 when the actuator unit 210 is in the retracted position (here, such that light passes from the light-emitting portion 231 to the light-receiving portion 232). The first coupled portion 225 is coupled to the catch portion 221*a* via a coupling portion 225*d*.

In the present embodiment, the sheet detection apparatus 200 is provided with a plunger-type solenoid apparatus 227 having a plunger (iron core), a solenoid, and a spring, with the plunger serving as the movable member 221, the solenoid serving as the drive apparatus 222, and the spring serving as the second biasing member SPb.

The drive apparatus 222 is connected to the output system of the control unit 100 (see FIG. 2), and when power is supplied from the control unit 100 to the drive apparatus 222 and the drive apparatus 222 is in an on state, the drive apparatus 222 generates a magnetic field.

Into the drive apparatus 222, the movable member 221 is inserted so as to be capable of sliding in the axial direction X. When power is supplied from the control unit 100 to the drive apparatus 222 and the drive apparatus 222 is in an on state, electromagnetic force is applied to the movable member 221, and when power from the control unit 100 is cut off and the drive apparatus 222 is in an off state, application of electromagnetic force to the movable member 221 is released. More specifically, when power is supplied from the control unit 100 to the drive apparatus 222, the drive apparatus 222 pulls in the movable member 221 against the biasing force of the second biasing member SPb with the drive power (electromagnetic force) generated to the other side X2 in the axial direction X, and when power from the control unit 100 is cut off and so drive force is released, the movable member 221 is caused to protrude by the biasing force of the second biasing member SPb.

In the sheet detection apparatus 200 provided with this configuration, the actuator unit 210 is biased in the retracting direction Q1 by the biasing force of the first biasing member SPa, and the movable member 221 is biased to the one side X1 in the axial direction X by the biasing force of the second biasing member SPb, so the operated portion 213 is positioned on the other side X2 (here, at the first coupled portion 225) in the axial direction X of the inclined portion 224, and thus the actuator unit 210 is in the retracted position, and the operated portion 213 is put in a state contacting the contact face 225*a* of the first coupled portion 225. In this state, when the drive apparatus 222 is in an on state, the movable member 221 moves to the other side X2 in the axial direction X against the biasing force of the second biasing member SPb, and with this movement, the operated portion 213 slides on a edge 224*a* in the axial direction X of the inclined portion 224 against the biasing force of the first biasing member SPa and climbs the inclined portion 224, and thus the actuator unit 210 rotates in the protruding direction Q2 (see FIG. 5(*b*)). When the movable member 221 further moves to the other side X2 in the axial direction, the operated portion 213 is positioned on the one side X1 (here, at the second coupled portion 226) in the axial direction X of the inclined portion 224, and thus the actuator unit 210 is in the protruding position, and the operated portion 213 is put in a state contacting the contact face 226*a* of the second coupled portion 226. When the drive apparatus 222 is in an off state, the movable member 221 moves to the one side X1 in the axial direction X due to the biasing force of the second biasing member SPb, and returns to the original position (default position). The operated portion 213 is rotated in the retracting direction Q1 by the biasing force of the first biasing member SPa and is positioned on the other side X2 in the axial direction X of the inclined portion 224 via the inclined portion 224, and is put in a state contacting the contact face 225*a* of the first coupled portion 225. Thus, the actuator unit 210 returns to the retracted position.

When the recording paper P transport timing (here, the leading edge P1 of the recording paper P) is detected by the upstream-side sheet detection unit 30, the control unit 100 switches on the drive apparatus 222 of the sheet detection apparatus 200. Also, using the timer 110, the control unit 100 switches off the drive apparatus 222 of the sheet detection apparatus 200 after passage of a sheet discharge time from the start of recording paper P transport detection by the upstream-side sheet detection unit 30 until that recording paper P is placed in the discharge tray 86.

Figure 6A:
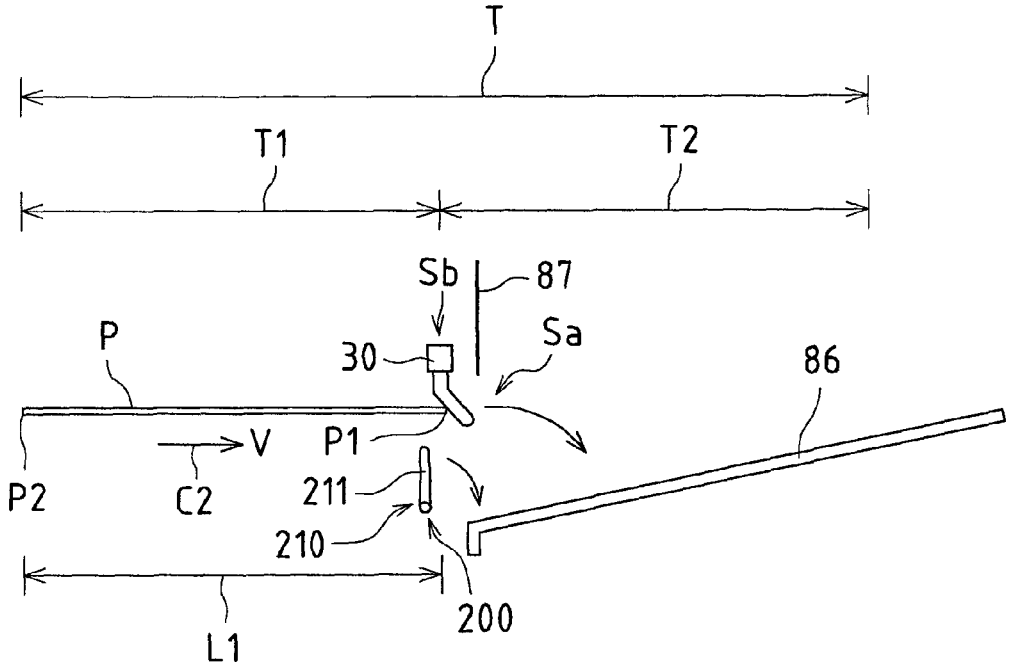
FIGS. 6(*a*) and 6(*b*) illustrate a sheet discharge time, with FIG. 6(*a*) illustrating the sheet discharge time when an upstream-side sheet detection unit detects the leading edge of a recording sheet, and FIG. 6(*b*) illustrating the sheet discharge time when the upstream-side sheet detection unit detects the trailing edge of a recording sheet.
Figure 6B:
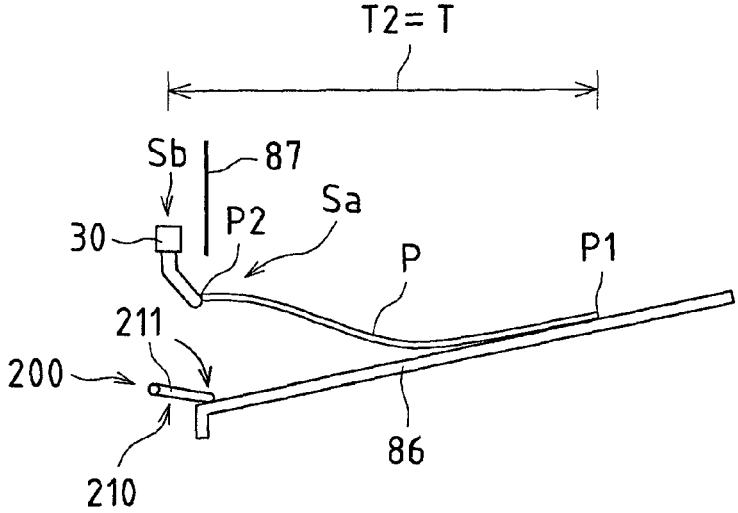

FIGS. 6(*a*) and 6(*b*) illustrate a sheet discharge time T. FIG. 6(*a*) illustrates the sheet discharge time T when the upstream-side sheet detection unit 30 detects the leading edge P1 of the recording paper P, and FIG. 6(*b*) illustrates the sheet discharge time T when the upstream-side sheet detection unit 30 detects the trailing edge P2 of the recording paper P.

As shown in FIG. 6(*a*), when the upstream-side sheet detection unit 30 detects the leading edge P1 of the recording paper P, the sheet discharge time T can be obtained by adding a second time T2 to a first time T1, with the first time T1 being obtained by dividing a length L1 of the recording paper P in the discharge direction C2 by a recording paper P transport speed V, and the second time T2 being the time that it takes for the recording paper P to travel from the detection position Sb of the upstream-side sheet detection unit 30 via the discharge opening Sa and be placed on the discharge tray 86. The size of the recording paper P can be detected by a conventionally known size detecting means. The length L1 in the discharge direction C2 of various sizes of recording paper P, transport speed V, and second time T2 can be stored in advance in the storage unit 101. The control unit 100 may also use a sheet discharge time T that has been stored in advance in the storage unit 101. In this case, it is possible to use a sheet discharge time T calculated with a maximum size of recording paper P, and store the sheet discharge time T calculated with a maximum size of recording paper P in advance in the storage unit 101.

Also, as shown in FIG. 6(*b*), when the upstream-side sheet detection unit 30 detects the trailing edge P2 of the recording paper P, sheet discharge time T can be set to the second time T2. The second time T2 that is the sheet discharge time T can be stored in advance in the storage unit 101.

Figure 7A:
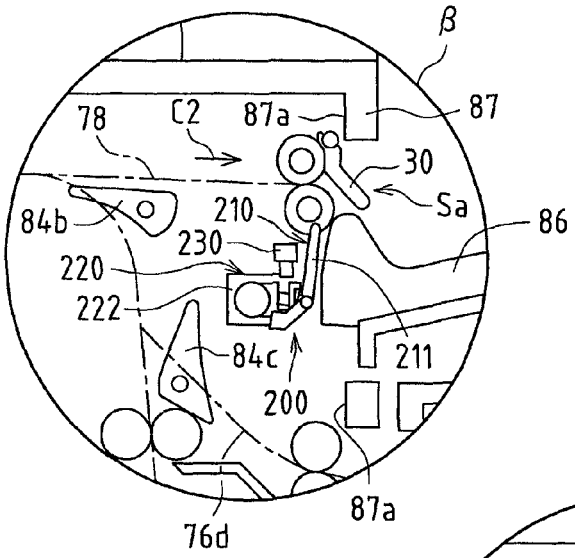
FIGS. 7(*a*) to 7(*c*) are schematic configuration views that show portion β of FIG. 3, with FIG. 7(*a*) showing an ordinary state before the upstream-side sheet detection unit detects the recording paper, FIG. 7(*b*) showing a transport detection state in which the upstream-side sheet detection unit is detecting the transport timing of the recording paper, and FIG. 7(*c*) showing a presence detection state in which the sheet detection apparatus is detecting whether or not there is recording paper placed in a discharge tray.
Figure 7B:
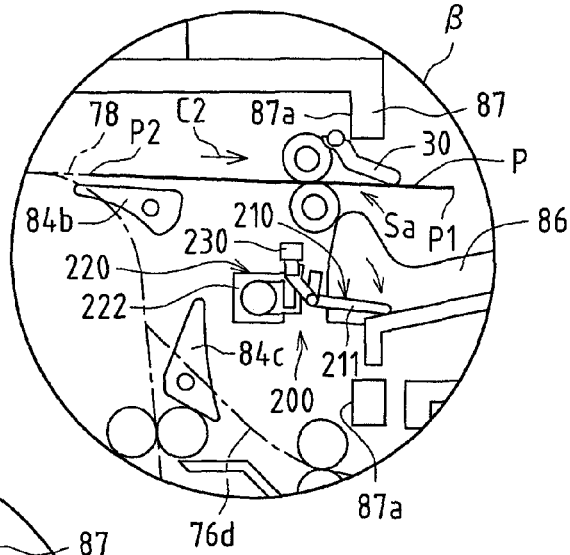
Figure 7C:
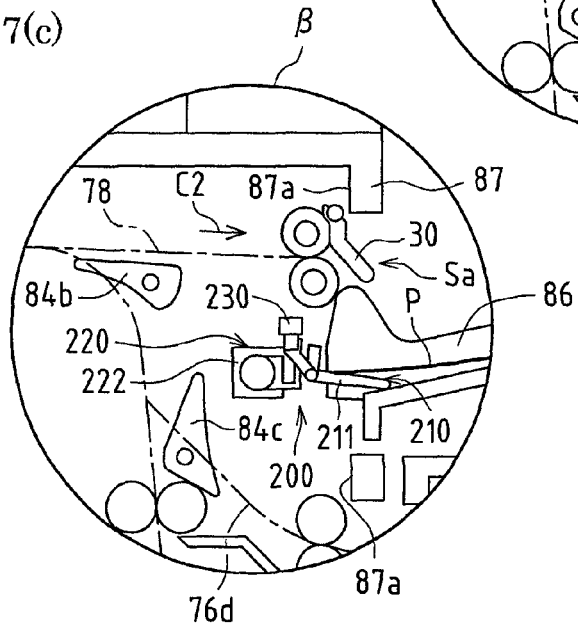
Figure 8:
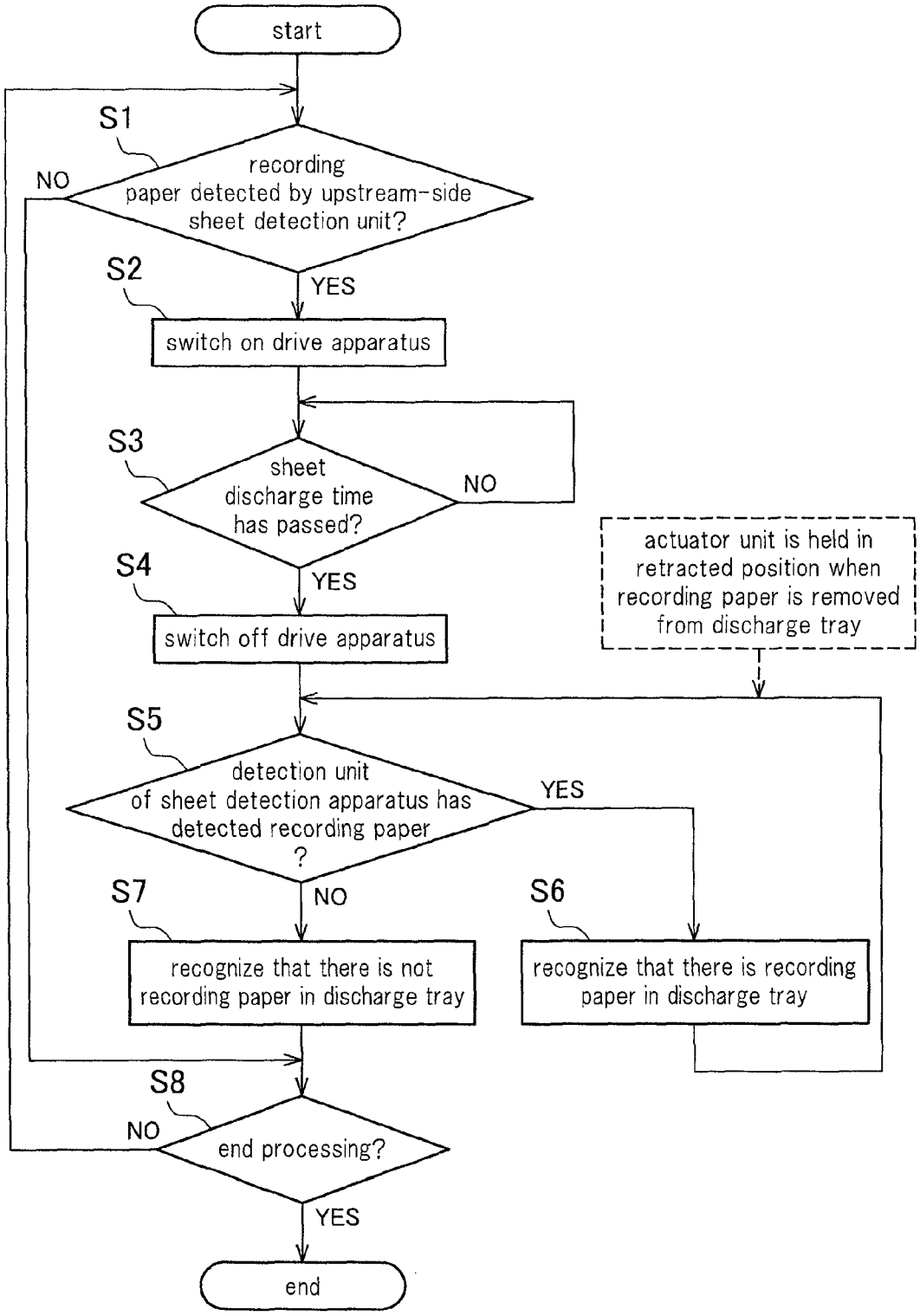
FIG. 8 is a flowchart that shows the flow of control of a control unit that performs a detection operation in which the upstream-side sheet detection unit and the sheet detection apparatus in the image forming apparatus operate in coordination.

FIGS. 7(*a*) to 7(*c*) are schematic configuration views that show a portion β of FIG. 3. FIG. 7(*a*) shows an ordinary state before the upstream-side sheet detection unit 30 detects the recording paper P. FIG. 7(*b*) shows a transport detection state in which the upstream-side sheet detection unit 30 is detecting the transport timing of the recording paper P. FIG. 7(*c*) shows a presence detection state in which the sheet detection apparatus 200 is detecting whether or not there is recording paper P placed in the discharge tray 86. FIG. 8 is a flowchart that shows the flow of control of the control unit 100 that performs a detection operation in which the upstream-side sheet detection unit 30 and the sheet detection apparatus 200 in the image forming apparatus 20 operate in coordination.

(Ordinary State)

In the image forming apparatus 20, in the ordinary state shown in FIG. 7(*a*), the control unit 100 switches off the drive apparatus 222, setting the actuator unit 210 to the retracted position, and thus the contacted portion 211 is housed within the main body 21. At this time, the control unit 100 waits until the recording paper P is transported and the transport timing (here, the leading edge P1) of the recording paper P is detected by the upstream-side sheet detection unit 30 (Step S1: NO).

(Transport Detection State)

In the transport detection state shown in FIG. 7(*b*), when the transport timing of the recording paper P is detected by the upstream-side sheet detection unit 30 (Step S1: YES), the control unit 100 switches on the drive apparatus 222 (Step S2), and so as to set the actuator unit 210 to the protruding position, rotates the contacted portion 211 toward the discharge tray 86 so that at least the tip end portion 211*a* is caused to overlap the sheet placement area W in the discharge tray 86.

Next, the control unit 100 measures the sheet discharge time T with the timer 110 and waits until the sheet discharge time T has passed (Step S3: NO). When the sheet discharge time T has passed (Step S3: YES), the control unit 100 switches off the drive apparatus 222 (Step S4), and the movable member 221 returns to the one side X1 in the axial direction X due to the biasing force of the second biasing member SPb, but the position of the actuator unit 210 differs depending on the state of the recording paper P on the discharge tray 86, as described below.

(Case of Recording Paper P Being in Discharge Tray 86)

Recording paper P that has been discharged from the discharge opening Sa is placed on the discharge tray 86 in a state with the contacted portion 211 of the actuator unit 210 interposed therebetween (see FIG. 7(*c*)).

When recording paper P that has been placed on the discharge tray 86 remains on the discharge tray 86, even if the drive apparatus 222 is switched to the off state, the contacted portion 211 of the actuator unit 210 does not return to the retracted position because of the weight of the recording paper P, so the actuator unit 210 remains in the protruding position, and therefore the presence of recording paper P is detected by the detection unit 230 (Step S5: YES), and a signal indicating that recording paper P is in the discharge tray 86 is sent to the control unit 100. That is, the detection unit 230 detects that recording paper P is in the discharge tray 86 when the actuator unit 210 does not return from the protruding state to the retracted position even though the drive apparatus 222 has been switched from the on state to the off state. Thus, the control unit 100 recognizes that there is recording paper P in the discharge tray 86 (Step S6), and returns to Step S5.

(Case of Recording Paper P Being Removed from Discharge Tray 86)

On the other hand, when recording paper P is removed from the discharge tray 86, the actuator unit 210 returns to the retracted position due to the biasing force of the first biasing member SPa, so the detection unit 230 detects that recording paper P is not present (Step S5: NO), and a signal indicating that recording paper P is not in the discharge tray 86 is sent to the control unit 100. That is, the detection unit 230 detects that recording paper P is not in the discharge tray 86 when the actuator unit 210 returns from the protruding state to the retracted position when the drive apparatus 222 has been switched from the on state to the off state. Thus, the control unit 100 recognizes that there is not recording paper P in the discharge tray 86 (Step S7), and moves to Step S8.

With Step S8, the processing of Steps S1 to S7 is repeated until processing ends.

As described above, according to the sheet detection apparatus 200 and the image forming apparatus 20 of the present embodiment, with the operation unit 220, it is possible to maintain the retracted state and keep the actuator unit 210 in the retracted position. Accordingly, in an ordinary state (for example, a state in which installation or removal work can be performed, such as a state in which power is off or a standby state), it is possible to retract the actuator unit 210 from the detection area α, and thus there is no interference from the actuator unit 210, so it is possible to improve workability for installing or removing a member (here, the discharge tray 86) provided near the actuator unit 210.

Moreover, according to the image forming apparatus 20, by the sheet detection apparatus 200 being provided in the main body 21 of the image forming apparatus 20, it is not necessary to consider attachment or removal of a connector (not shown) of a connection cable in the sheet detection apparatus 200 when installing or removing the discharge tray 86, and to that extent it is possible to improve workability for installing or removing the discharge tray 86.

Also, when switched off, the operation unit 220 maintains the retracted state and sets the actuator unit 210 to the retracted position, and when switched on, the operation unit 220 switches to the protruding state and sets the actuator unit 210 to the protruding position, so in a state in which power is off, it is possible to keep the actuator unit 210 in the retracted position. Thus, it is possible to more easily perform work of installing or removing the discharge tray 86 in a state in which the power is off.

Also, the actuator unit 210 has the contacted portion 211, the detected portion 212, and the operated portion 213; the detection unit 230 detects the detected portion 212; and the operation unit 220 rotates the operated portion 213 around the rotational axis 210*a*, so it is possible to realize a retracted state for the actuator unit 210 by the operation unit 220 with a simple configuration of the actuator unit 210.

Also, in the actuator unit 210, the contacted portion 211 and the detected portion 212 are provided so as to form an obtuse angle in the circumferential direction of the rotational axis 210*a*, and the operated portion 213 is provided between the contacted portion 211 and the detected portion 212 that form an obtuse angle in the circumferential direction of the rotational axis 210*a*, so the operation unit 220 and the detection unit 230 can be provided in a balanced manner with respect to the actuator unit 210, and thus it is possible to realize a more compact configuration of the sheet detection apparatus 200.

In the operation unit 220, the movable member 221, the drive apparatus 222, and the rotating member 223 are provided, so with a simple configuration of converting back-and-forth movement of the movable member 221 to rotational movement of the rotational axis 210*a* via the operated portion 213 by the rotating member 223, it is possible to rotate the actuator unit 210 around the rotational axis 210*a*.

Also, the actuator unit 210 is put in a state biased in the retracting direction Q1, and the movable member 221 is put in a state biased in the one direction X1 in the axial direction X, and the drive apparatus 222 drives the movable member 221 so as to move to the other side X2 in the axial direction X when switched on, and the operated portion 213 slides in the inclined portion 224 in the rotating member 223 against the biasing force in the retracting direction Q1 of the actuator unit 210 according to movement to the other side X2 in the axial direction X of the movable member 221, and thus is rotated in the protruding direction Q2, so it is possible to realize the retracted state for the actuator unit 210 by the operation unit 220 when switched off with a simple configuration, and moreover, in a state in which a load (here, the weight of recording paper P) is applied to the contacted portion 211 and the actuator unit 210 is in the protruding position, it is possible to automatically return the actuator unit 210 to the retracted position with the biasing force of the first biasing member SPa on the actuator unit 210 when the load on the contacted portion 211 is released (here, when recording paper P is removed).

Also, the plunger-type solenoid apparatus 227 is provided, so a general-purpose plunger-type solenoid apparatus can be used, and thus, it is possible to realize the retracted state for the actuator unit 210 by the operation unit 220 when switched off with an inexpensive and simple configuration.

Also, the detection unit 230 is a light sensor, so it is possible to use a general-purpose light sensor, and thus it is possible to inexpensively and reliably detect the detected portion 212.

Also, the sheet detection apparatus 200 is provided in the main body 21 of the image forming apparatus 20, so it is not necessary to perform attachment or removal of a connector (not shown) of a connection cable of the sheet detection apparatus 200 when installing or removing the discharge tray 86, and thus it is possible to more easily perform work of installing or removing the discharge tray 86. Thus, for example, this configuration can be suitably used when the discharge tray 86 is added as an option.

Also, in sheet detection control by the control unit 100, when detecting the transport timing of recording paper P with the upstream-side sheet detection unit 30, the operation unit 220 is switched on, and the operation unit 220 is switched off after passage of the sheet discharge time T, so it is possible to switch off the operation unit 220 of the sheet detection apparatus 200 when recording paper P is in the discharge tray 86. At this time, even if the operation unit 220 is switched off, the actuator unit 210 remains in the protruding position due to the weight of the recording paper P that has been placed in the discharge tray 86, so it is possible for the detection unit 230 of the sheet detection apparatus 200 to detect that there is recording paper P in the discharge tray 86. On the other hand, when the operation unit 220 is off, the retracted state is maintained and the actuator unit 210 is set to the retracted position, so when recording paper P is removed from the discharge tray 86, the actuator unit 210 automatically adopts the retracted position. Thus, after the operation unit 220 has been switched off, in a state with the actuator unit 210 in the protruding position due to the weight of the recording paper P, the recording paper P is detected, and after the recording paper P has been removed, the actuator unit 210 automatically adopts the retracted position.

Accordingly, without supplying power to the operation unit 220, by utilizing the weight of the recording paper P, the protruding state is maintained and the actuator unit 210 is set to the protruding position by the recording paper P that has been placed in the discharge tray 86, and when the recording paper P is afterward removed from the discharge tray 86, the actuator unit 210 moves from the protruding position to the retracted position due to the biasing force of the first biasing member SPa on the actuator unit 210, so the operation unit 220 can be automatically switched from the protruding state to the retracted state.

Depending on the direction in which the sheet detection apparatus 200 is disposed, in the sheet detection apparatus 200 a configuration may be adopted in which the actuator unit 210 is biased in the retracting direction Q1 by its own weight rather than by the first biasing member SPa, and the movable member 221 may be biased to the one side X1 in the axial direction X by its own weight rather than by the second biasing member SPb. Also, in the present embodiment, the sheet detection apparatus 200 is applied to detect whether or not there is recording paper P in the discharge tray 86, but the sheet detection apparatus 200 may also be applied to detect whether or not there is recording paper P in a paper feed tray, for example. The sheet detection apparatus 200 may also be applied to detection (detection of transport timing) of recording paper P transported in the image forming apparatus 20. In this case, detection of recording paper P transported in the image forming apparatus 20 can be performed by setting the transport direction of the recording paper P to the direction such that the actuator unit 210 rotates in the protruding direction Q2.

Also, in the present embodiment, the sheet detection apparatus 200 detects recording paper P, but a configuration may also be adopted in which the sheet detection apparatus 200 detects an original sheet from which an original image will be read by the original transport/reading unit 22, or detects an original sheet from which an original image has been read. Also, in the present embodiment, the sheet detection apparatus 200 is used to detect recording paper P in an image forming apparatus, but the sheet detection apparatus 200 can also be used to detect an original sheet on an original tray in a scanner apparatus, or to detect an OHP (overhead projector) sheet on an OHP sheet feed tray in an OHP provided with an OHP sheet transport apparatus.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A sheet detection apparatus provided in an image forming apparatus, the image forming apparatus being equipped with a discharge tray where a sheet that has been transported within a main body of the image forming apparatus and then discharged outside of the main body is placed, and the sheet detection apparatus being for detecting whether or not there is a sheet in the discharge tray, the sheet detection apparatus comprising:

an actuator unit that is rotatable around a rotational axis so as to adopt any of a protruding position in which the actuator unit protrudes into a detection area for detecting the sheet and a retracted position in which the actuator unit is retracted from the detection area;

an operation unit that is capable of switching between a retracted state in which the actuator unit is set to the retracted position and a protruding state in which the actuator unit is set to the protruding position, wherein the protruding position is such that a tip end of the actuator unit overlaps a sheet placement area in the discharge tray, the retracted position is such that the tip end of the actuator unit is retracted from the sheet placement area, the operation unit sets the actuator unit to the protruding position when a sheet is detected on an upstream side relative to the discharge tray in a sheet discharge direction, and after passage of a sheet discharge time from the start of sheet transport detection until the sheet is placed on the discharge tray, the actuator unit is urged from the protruding position to the retracted position;

a detection unit that detects the actuator unit, wherein the actuator unit has a contacted portion contacted by the sheet to be detected, a detected portion detected by the detection unit, and an operated portion operated by the operation unit, the detection unit detects the detected portion, and the operation unit rotates the operated portion around the rotational axis, wherein the operation unit is provided with a movable member capable of moving back-and-forth in the axial direction of the rotational axis, a drive apparatus that moves the movable member, and a rotating member that is provided in the movable member and rotates the operated portion around the rotational axis according to movement of the movable member, and, wherein the actuator unit is set to a biased state biased in the retracting direction in which the actuator unit rotates to the retracted position, the movable member is set to a biased state biased in one direction in the axial direction, the drive apparatus drives so as to move the movable member to the other side in the axial direction when the operation unit is on, the rotating member has an inclined portion that is inclined in the axial direction between the one side and the other side in the axial direction, and the operated portion, by sliding on the inclined portion against biasing force in the retracting direction of the actuator unit according to movement to the other side in the axial direction of the movable member, is rotated in the protruding direction opposite to the retracting direction.

2. The sheet detection apparatus according to claim 1, comprising a plunger-type solenoid apparatus having a plunger and a solenoid, wherein the plunger serves as the movable member, and the solenoid serves as the drive apparatus.

3. A sheet detection apparatus that detects a sheet, the apparatus comprising:

an actuator unit that is rotatable around a rotational axis so as to adopt any of a protruding position in which the actuator unit protrudes into a detection area for detecting the sheet and a retracted position in which the actuator unit is retracted from the detection area, wherein the actuator unit is set to a biased state biased in the retracting direction in which the actuator unit rotates to the retracted position;

an operation unit that is capable of switching between a retracted state in which the actuator unit is set to the retracted position and a protruding state in which the actuator unit is set to the protruding position; and a detection unit that detects the actuator unit, wherein the operation unit is provided with a movable member capable of moving back-and-forth in the axial direction of the rotational axis, a drive apparatus that moves the movable member, and a rotating member that is provided in the movable member and rotates an operated portion around the rotational axis according to movement of the movable member, wherein the movable member is set to a biased state biased in one direction in the axial direction, the rotating member has an inclined portion that is inclined in the axial direction between the one side and the other side in the axial direction, the operation unit rotates the operated portion around the rotational axis, the actuator unit has a contacted portion contacted by the sheet to be detected, a detected portion detected by the detection unit, and the operated portion operated by the operation unit, the drive apparatus drives so as to move the movable member to the other side in the axial direction when the operation unit is on, and the operated portion, by sliding on the inclined portion against biasing force in the retracting direction of the actuator unit according to movement to the other side in the axial direction of the movable member, is rotated in the protruding direction opposite to the retracting direction.

4. The sheet detection apparatus according to claim 3, comprising a plunger-type solenoid apparatus having a plunger and a solenoid, wherein the plunger serves as the movable member, and the solenoid serves as the drive apparatus.

* * * * *